US006601575B2

(12) United States Patent
Gros et al.

(10) Patent No.: US 6,601,575 B2
(45) Date of Patent: Aug. 5, 2003

(54) WINDOW FOR A HOT CHAMBER THAT IS SEALED OFF FROM THE SURROUNDINGS

(75) Inventors: Oliver Gros, Rheinboellen (DE); Kurt Leuntner, Mainz (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 10/220,588

(22) PCT Filed: Feb. 10, 2001

(86) PCT No.: PCT/EP01/01475

§ 371 (c)(1),
(2), (4) Date: Sep. 3, 2002

(87) PCT Pub. No.: WO01/69137

PCT Pub. Date: Sep. 20, 2001

(65) Prior Publication Data

US 2003/0029440 A1 Feb. 13, 2003

(30) Foreign Application Priority Data

Mar. 15, 2000 (DE) ..... 100 12 577

(51) Int. Cl.[7] ..... F23M 7/00
(52) U.S. Cl. ..... 126/200; 126/190; 126/198
(58) Field of Search ..... 126/190, 200, 126/21 R, 198, 193; 52/204.593

(56) References Cited

U.S. PATENT DOCUMENTS 2,025,770 A * 12/1935 Parkinson et al. ..... 126/200
2,231,514 A * 2/1941 Verjagen ..... 126/200
4,048,978 A * 9/1977 Plumat et al. ..... 126/200
5,588,421 A * 12/1996 Busch ..... 126/200

FOREIGN PATENT DOCUMENTS

| | | |
|---|---|---|
| DE | 36 37 064 C1 | 3/1988 |
| DE | 39 15 687 C2 | 9/1991 |
| DE | 43 33 033 C1 | 5/1995 |
| DE | 44 07 084 A1 | 9/1995 |
| DE | 198 02 688 C | 7/1999 |
| EP | 0 646 753 B1 | 8/1998 |
| EP | 0 731 318 B1 | 9/1998 |

* cited by examiner

*Primary Examiner*—James C. Yeung
(74) *Attorney, Agent, or Firm*—Michael J. Striker

(57) ABSTRACT

The window for a hot chamber sealed off from the surroundings includes a multi-pane module. The multi-pane module has at least two transparent panes (1, 2) held apart by peripheral spacers (3) and interconnected with the peripheral spacers (3) in a gas-tight fashion so that the transparent panes and spacers bound an interior space (9). The peripheral spacers (3) are provided with at least one through-going opening (5), each of which is closed with a replaceable, permeable filter pad (6). This permeable filter pad (6) permits gases to penetrate the filter pad (6) for gas exchange in order to prevent pressure build up in the interior space between the panes and spacers, but prevents water vapor and other vapors containing grease, oil and other contaminating particles from entering the interior space. The panes may be composed of thermally and/or chemically prestressed borosilicate flat glass or transparent glass ceramic and the spacers may be composed of stainless steel, aluminum or a sufficiently temperature-stable plastic.

7 Claims, 1 Drawing Sheet

WINDOW FOR A HOT CHAMBER THAT IS SEALED OFF FROM THE SURROUNDINGS

BACKGROUND OF THE INVENTION

The invention relates to a window for a hot chamber, which is sealed off from its surroundings. The window comprises a multi-pane module having at least two transparent panes held apart by peripheral spacers, which panes are interconnected with the spacers in gas-tight fashion.

Hot chambers that are sealed off from their surroundings and have high temperatures during operation typically have a window to allow viewing of the hot chamber from the outside. Depending on the application, the window can be permanently installed in the walls bordering the hot chamber. In the case of a typical application, however, the window can also be integrated in a door of a wall bordering the hot chamber. Typical examples of this are oven doors, such as doors of ovens used for baking, in particular those with pyrolytic self-cleaning features, or microwave ovens.

Windows can also be provided in fireproof doors that seal off a chamber that becomes a hot chamber if fire breaks out.

Windows for the aforementioned purposes typically comprise multi-pane modules having at least two glass panes held apart by spacers in a connecting frame.

A window of this type for an oven door is presented, for example, in DE 44 07 084 A1 (=EP 0731 318 B 1). The known window has a window assembly having two glass panes arranged in a connecting frame, which forms a glass pane composite. This window assembly is mounted in the door with an empty layer of air separating it from a front glass pane and forms a multi-pane module with the front glass pane. The glass pane composite—which itself is vapor-tight—is formed by a peripheral seal, in particular a glass fiber seal, that is effective even under the influence of heat, in order to prevent water vapor or steam from the oven muffle from entering the space between the two glass panes of the window assembly and soiling the window. In order to keep such water vapor and steam away from the front pane of the window as well, a peripheral flow barrier is also provided in the empty space between the front pane and the window assembly. This known construction has the disadvantage in particular that pressure builds up because of an increase in temperature throughout the hermetically sealed, empty space between the glass panes of the window assembly, which significantly shortens the service life of the multi-pane module.

In order to compensate for this pressure increase, the known construction according to DE 43 33 033 C1 (EP 0 646 753 B1) provides a spacer developed as a compressible silicone tube. The tube volume makes pressure compensation possible when temperature changes occur. The panes separated by the spacer are interconnected with each other, together with the spacer, in hermetically-sealed fashion by means of a temperature-resistant bonding agent, in particular a silicone bonding agent.

The glass pane exposed to the internal chamber temperature of the apparatus is typically composed of THERMAX 5000®, a prestressed soda-lime float glass coated in heat-reflecting fashion, and the glass pane exposed to the ambient temperature and, if applicable, a further internal intermediate pane, are composed of DURAX®, a prestressed soda-lime float glass.

As a result of the compressible spacer, the distance between the glass panes depends on the temperature, because of which special structural requirements are placed on the design of the mechanical holders of the glass panes, the interconnecting frame. Moreover, the spacer is continuously subjected to deformations, which does not have a favorable effect in terms of material fatigue.

A window for fire-retardant glass having a multi-pane module is described in DE 36 37 064 C2 in which the panes are held apart by a sealing mass, on the one hand, and, on the other, are interconnected in sealed fashion. This multi-pane module has a very expensive pressure compensation system with valves that open in case of fire and release the gas pressure building up as a result of increasing temperature before it causes the panes to burst. Such a multi-pane module can also be provided with a metallic frame at considerable production-engineering expense. DE 39 15 687 C2 teaches an edge enclosure composed of a flexible, gas-permeable band for this module.

An evacuated insulating glass composed of two panes having, e.g., cylindrical, spacers between them distributed according to a certain pattern is also known. The edges of the glass panes are hermetically sealed using either glass solder or metal solder in order to prevent air from entering. The distance between the panes is approximately 100 $\mu$m.

This multi-pane module has a number of disadvantages. For instance, thermally and/or chemically prestressed glass cannot be used, since the soldering temperatures are typically higher than the relaxation temperature of the prestressed glass. Moreover, the flatness of thermally prestressed glasses has deviations that make it impossible to realize the extremely close separations. Destressed glass must either have a thickness of at minimum 6 mm in order to withstand the vacuum, as a result of which the module becomes extremely heavy, or the spacer pattern must be configured so that it is sealed very tightly, which makes it difficult to look through. When special solders for low soldering temperatures are used, the seal is at risk of breaking during use. Additionally, it must be assumed that the panes will bend under the temperature load and then touch each other; prevention of thermal conductance would no longer be ensured.

SUMMARY OF THE INVENTION

It is an object of the present invention to provide a window of the above-described kind for a hot chamber sealed off from the surroundings, designed as a multi-pane module having at least two transparent panes held apart by peripheral spacers, which are interconnected in gas-tight fashion with the spacers, so that, despite the gas-tight connection between the spacers and the panes, pressure compensation can be obtained between the space between the panes and the surroundings using simple means without allowing the windows to become soiled.

This object is attained according to the invention by providing at least one opening in the spacers that is closed with a permeable filter that allows gasses to penetrate for purposes of pressure compensation, but prevents steam and water vapor from entering.

If increased pressure resulting from a temperature increase therefore develops in the space between the panes, air can escape from the interior space via the filter. When the space between the panes cools down again, filtered ambient air flows back into the intermediate space. Any steam or water vapor is thereby deposited in the filter and is filtered out. According to a preferred embodiment of the invention, the filter is advantageously replaceable. The filter is preferably a filter pad for this purpose.

According to another preferred embodiment, the panes are preferably made out of a glass having high thermal resistance, e.g., a thermally and/or chemically prestressed borosilicate glass.

According to an alternative preferred embodiment, the panes are composed of a glass ceramic that is highly temperature-resistant.

According to an advantageous embodiment of the invention, the spacers are preferably composed of stainless steel, aluminum, or a sufficiently temperature-resistant plastic.

To obtain an interconnected assembly, the spacers are bonded with the panes, according to an embodiment of the invention, using a temperature-resistant bonding agent, preferably a silicone bonding agent.

In order to obtain a further temperature reduction in the pane facing away from the hot chamber, the window according to the invention is advantageously designed so that at least one of the panes is provided with a thermal radiation-reflecting layer on at least one side.

BRIEF DESCRIPTION OF THE DRAWING

The invention is described hereinbelow with reference to an exemplary embodiment shown in the drawings.

DETAILED DESCRIPTION OF THE INVENTION

Figure 1:
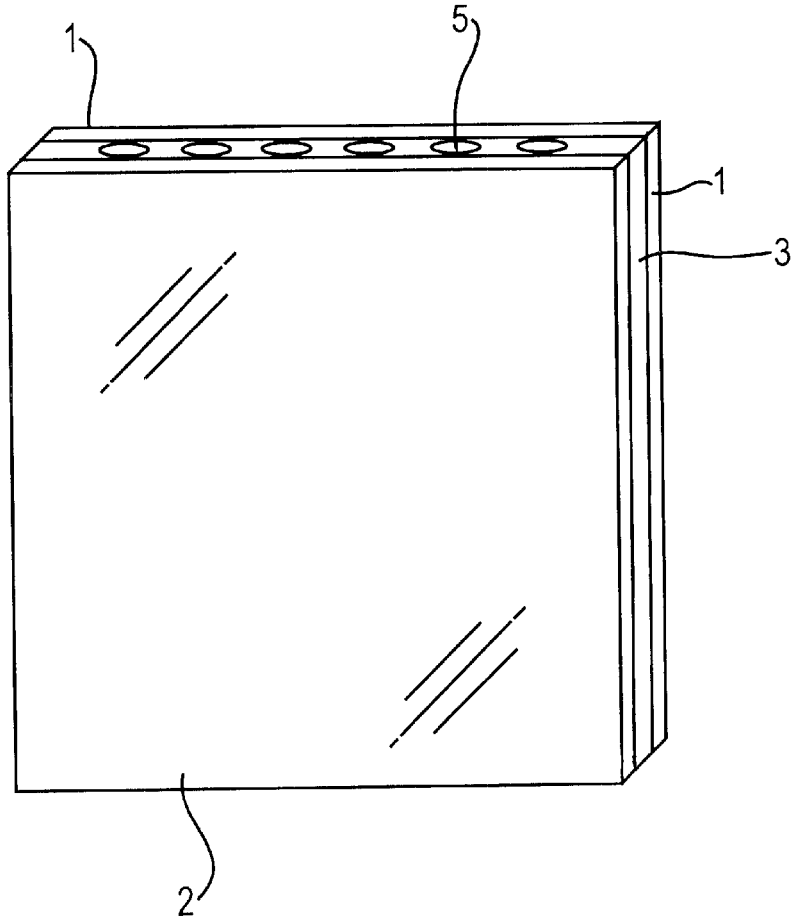
FIG. 1 is a schematic, perspective front view of an exemplary embodiment of a multi-pane module having filters in the pane spacers.
Figure 2:
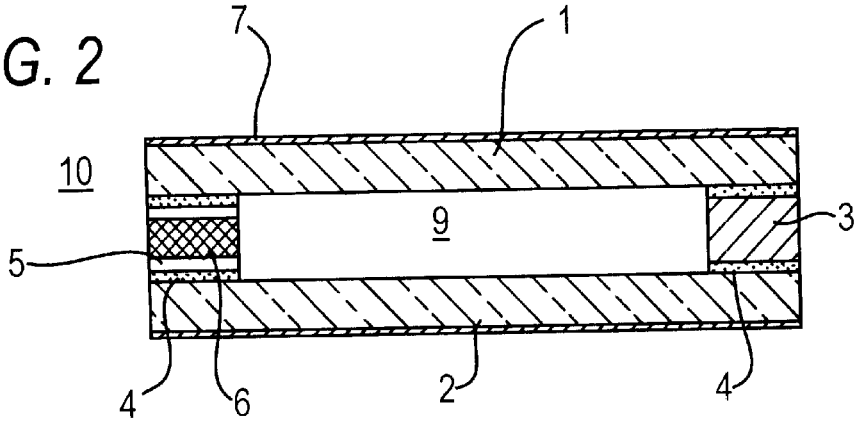
FIG. 2 is a cross-sectional view of the module according to FIG. 1.

The exemplary embodiment of the multi-pane module, according to the invention, of a window for a hot chamber that is sealed off from the surroundings shown in FIGS. 1 and 2 has two transparent panes 1 and 2 that are held in a not shown frame.

The panes 1 and 2 are composed of glass having high thermal resistance, typically a chemically or thermally pre-stressed borosilicate flat glass, or a transparent glass ceramic.

Both panes are held apart at a specified distance by spacers 3 on the periphery so that the panes 1,2 and the spacers bound an interior space 9. The spacers 3 are typically composed of stainless steel, aluminum, or a sufficiently temperature-resistant plastic.

The spacers 3 are bonded with the glass and/or glass ceramic panes 1 and 2 using a temperature-stable bonding agent, typically a silicone bonding agent, to form an interconnection, which is indicated in FIG. 2 by the bonding seam 4.

Moreover, the spacers 3 have bores or through-going openings 5 between the interior space and the surroundings 10 on at least one side of the module, on the top side according to FIG. 1, and also on the lateral spacers according to FIG. 2. These through-going openings 5 are filled with a filter material 6 that slows the rate of gas exchange between the interior space 9 and the surroundings 10, on the one hand, but also prevents pressure from building up in the space between the two panes 1, 2 and, on the other hand, also prevents penetration by water vapor in the form of grease, oil and other contaminating particles, which can soil the interior space 9 between the panes.

The multi-pane module "breathes", so to speak, through the filter unit.

The panes 1, 2 are preferably coated in thermal-reflecting fashion, which is indicated in FIG. 2 by the layer 7. The layers face each other when panes are coated on one side. Panes coated on both sides can be used as well. As a result of the invention, the main mechanisms of heat transmission: radiation (by an IR reflectance layer), convection (by reduced gas exchange), and conductance (by the use of poor heat conductors such as glass, ceramic, wood, plastics) can be eliminated in simple fashion, and the disadvantages of known systems do not occur.

The filter 6 is preferably a filter pad so the filter can be replaceable. The openings in the spacers that are closed by a filter are therefore formed preferably in the easily-accessible area of the spacers.

The multi-pane module according to the invention is used in combination with a front pane—installed with an intermediate separation—in an oven door, preferably as a door assembly. The empty space between the module and the front pane is advantageously ventilated in order to keep the temperature of the front pane as low as possible, even during the phase of pyrolytic self-cleaning.

What is claimed is:

1. A window for a hot chamber, said hot chamber being sealed off from surroundings thereof, said window comprising a multi-pane module;

wherein said multi-pane module comprises at least two transparent panes (1,2);

peripheral spacers (3) holding said at least two transparent panes (1,2) spaced apart from each other at a predetermined distance from each other so that said transparent panes (1,2) and said spacers (3) bound an interior space (9) between the transparent panes (1,2), wherein said at least two transparent panes are interconnected with the peripheral spacers (3) in a gas-tight fashion and said spacers (3) are provided with at least one through-going opening (5) between said interior space (9) and surroundings (10) of the multi-pane module; and a respective replaceable, permeable filter pad (6) arranged in each of said at least one through-going opening (5) so as to close said interior space (9) bounded by said transparent panes and said spacers, but wherein said permeable filter pad (6) permits gases to penetrate therethrough for gas exchange between said interior space (9) and said surroundings (10) of the multi-pane module in order to prevent pressure from building up in said interior space, but prevents water vapor and other vapors, said other vapors comprising grease, oil and contaminating particles, from entering said interior space from said surroundings (10).

2. The window as defined in claim 1, wherein said panes are composed of a thermally pre-stressed borosilicate flat glass, a chemically pre-stressed borosilicate flat glass or a thermally and chemically pre-stressed borosilicate flat glass.

3. The window as defined in claim 1, wherein said panes are composed of a transparent glass ceramic.

4. The window according to claim 1, wherein said spacers (3) are composed of stainless steel, aluminum or a temperature-stable plastic.

5. The window according to claim 1, further comprising a temperature-stable bonding agent adhesively bonding the spacers (3) with the transparent panes (1,2) so as to interconnect said spacers with said panes in said gas-tight fashion.

6. The window according to claim 5, wherein said temperature-stable bonding agent is a silicone-bonding agent.

7. The window according to claim 1, wherein at least one of said transparent panes (1,2) is provided with a thermal-radiation-reflecting layer (7) on at least one side thereof.

* * * * *